US005773281A

United States Patent [19]

Ichikawa et al.

[11] Patent Number: 5,773,281

[45] Date of Patent: Jun. 30, 1998

[54] APPARATUS FOR TREATING RAW GARBAGE

[75] Inventors: Masaya Ichikawa; Junichi Ooki, both of Kariya; Toru Muramatsu, Chiryu, all of Japan

[73] Assignee: Nippondenso Co., Ltd., Kariya, Japan

[21] Appl. No.: 639,084

[22] Filed: Apr. 24, 1996

[30] Foreign Application Priority Data

| | | | |
|---|---|---|---|
| Apr. 25, 1995 | [JP] | Japan | 7-101265 |
| Jun. 28, 1995 | [JP] | Japan | 7-161806 |
| Mar. 29, 1996 | [JP] | Japan | 8-075990 |

[51] Int. Cl.[6] ..... C12M 3/00

[52] U.S. Cl. ..... 435/290.2; 4/286; 4/DIG. 4; 241/DIG. 38

[58] Field of Search ..... 435/290.1, 290.2; 4/286, DIG. 4; 210/174; 241/DIG. 38

[56] References Cited

FOREIGN PATENT DOCUMENTS

| | | | |
|---|---|---|---|
| 4114160 | 5/1992 | Germany | 435/290.4 |
| 1-192923 (A) | 8/1989 | Japan | 4/DIG. 4 |
| 3-111301 (A) | 5/1991 | Japan | 4/DIG. 4 |
| 6-296550 | 7/1996 | Japan . | |

*Primary Examiner*—David A. Redding

*Attorney, Agent, or Firm*—Cushman Darby & Cushnman IP Group of Pillsbury Madison & Sutro LLP

[57] ABSTRACT

Water contained in raw garbage introduced through a throw port is drained off by a filter member and a water-draining gate, and is drained into a drainpipe, the water having good quality. The raw garbage from which water is drained off to a sufficient degree is dry-pulverized by a pulverizer unit and is smoothly blown into the microorganism decomposition chamber through a carrier duct having a flared end, utilizing the impact force of the impeller revolving in the pulverizer unit. The dry-pulverized raw garbage that is thus conveyed is decomposed by a microorganism carrier in the microorganism decomposition chamber.

14 Claims, 15 Drawing Sheets

APPARATUS FOR TREATING RAW GARBAGE

BACKGROUND OF THE INVENTION

1. Field of the Invention

The present invention relates to an apparatus for treating raw garbage from a kitchen or the like.

2. Description of the Related Art

The applicant has previously proposed, in Japanese Patent Application No. 6-296550, an apparatus for treating raw garbage from a kitchen or the like by continuously pulverizing, dehydrating and decomposing the raw garbage with microorganisms.

The above-mentioned apparatus is advantageous in that in a continuous action, raw garbage is pulverized while water is fed in, the pulverized raw garbage in the form of a liquid is dehydrated, and the dehydrated pulverized raw garbage is decomposed with microorganisms. However, a problem arises in that the pulverized fine raw garbage infiltrates into the water that is removed and drained during dehydration causing the quality of the drainage to deteriorate. In order to reduce the amount of fine raw garbage in the drainage, a filter can be employed for dehydration having small apertures. In this case, however, the filter tends to become blocked so that the filter must be replaced frequently.

SUMMARY OF THE INVENTION

The present invention was accomplished with the above in mind, and its object is to provide an apparatus for treating raw garbage wherein the raw garbage is pulverized after the water contained therein is drained off, so that pulverized fine raw garbage does not infiltrate into the drainage.

In order to solve the above-mentioned problem, according to a first aspect of the present invention, the water contained in the raw garbage is drained, and the garbage from which the water has been drained off is dry-pulverized in a pulverizer unit and is conveyed through a carrier duct into a microorganism decomposition unit where it is decomposed into odorless and harmless gases ($CO_2$ and $H_2O$). The decomposed gases are then discharged through a discharge pipe to the open air together with the drainage from the drainpipe.

The water contained in the raw garbage is drained through the drainpipe before the garbage is pulverized. That is, the drainage discharged to the outside from the drainpipe through the discharge pipe does not contain fine pulverized raw garbage and, hence, the quality of the drainage is not deteriorated but is favorably maintained.

According to a second aspect of the present invention, the water contained in the raw garbage flows through drain holes formed in the periphery of the pulverizer unit. In this case, a shut-off member is closed so that the passage between the water-draining unit and a pulverizer rotor is shut off to prevent the water from flowing into the pulverizer unit. Therefore, the raw garbage in the pulverizing unit does not contain large amounts of water, and decomposition with microorganisms is not adversely affected in the microorganism decomposition unit.

According to a third aspect of the present invention, it is possible to obtain the same effects as those of the second aspect of the present invention, namely, preventing garbage with high water content from entering the pulverizing unit.

According to a fourth aspect of the present invention, the shut-off member is formed in an upwardly protruded spherical shape. This makes it possible to collect the contained water in the peripheral portion of the shut-off member when passage between the water-draining unit and the pulverizer rotor is shut off by the shut-off member, thus permitting the water to easily flow out through the drain holes formed in the peripheral wall.

According to a fifth aspect of the present invention, after the water has been drained from the raw garbage, it is pulverized by rotating the pulverizer rotor, which drives a hammer and by a fixed blade. The garbage is further pulverized by guide plates that are inclined by a predetermined angle on the inner wall of the fixed blade, and the pulverized raw garbage is forced to fall down through a gap between the pulverizer rotor and the fixed blade. Therefore, the ability of pulverization increases particularly when the raw garbage is dry-pulverized.

According to a sixth aspect of the present invention, the pulverized raw garbage is forced to fall down through a gap between the pulverizer rotor and the fixed blade owing to a squeezing portion of the casing formed at an upper part of the fixed blade, exhibiting the same effects as those of the fifth aspect of the present invention.

According to a seventh aspect of the present invention, the pulverized raw garbage that has fallen through the gap between the pulverizer rotor and the fixed blade is thrown off into the microorganism decomposition unit from the carrier duct by the impact of a rotary vane that is rotating while interlocked to the pulverizer rotor. Here, since the carrier duct is expanded toward the microorganism decomposition unit, even the dry-pulverized raw garbage having poor fluidity is smoothly conveyed without clogging the carrier duct.

According to an eighth aspect of the present invention, air is introduced into the microorganism decomposition unit and is expelled to the outside by a suction-type ventilation system. Therefore, decomposition gases generated in the microorganism decomposition unit are expelled to the outside together with the external air, and smooth ventilation is accomplished in the microorganism decomposition unit.

According to a ninth aspect of the present invention, the microorganism carrier is heated to a temperature that kills vermin that breed in the microorganism carrier but does not kill microorganisms carried by the microorganism carrier. Therefore, the activity of the microorganisms is maintained and breeding of vermin in the microorganism carrier is suppressed so that and vermin do not come out to the sink from the microorganism decomposition unit when the shut-off closure is opened to throw in the raw garbage.

According to a tenth aspect of the present invention, a check valve prevents the drainage and decomposition gases discharged through the discharge pipe from flowing back into the microorganism decomposition unit and, hence, the decomposition ability is not diminished in the microorganism decomposition unit.

According to an eleventh aspect of the present invention, when the shut-off member is opened or is turned so that the passage is opened between the water-draining unit and the pulverizer rotor, the raw garbage from which the water has been drained off falls accumulates on the upper part of the pulverizer rotor. When the accumulated raw garbage reaches a predetermined level, a control means rotates the pulverizer rotor in the forward direction and in the reverse direction at a predetermined frequency for a predetermined period of time. Prior to being pulverized, therefore, the raw garbage is shaken so that the raw garbage on the upper part of the pulverizer is flattened, resulting in that it does not hinder the turning of the shut-off member.

According to a twelfth aspect of the present invention, when the shut-off member fails to turn to a predetermined position, the control means regards it as abnormal, and stops the operation of the pulverizer rotor and further generates an abnormal signal. This makes it possible to avoid improper draining of water from the raw garbage caused by abnormal turning of the shut-off member, thus preventing a drop in performance of the drainage and preventing a decrease in the ability of decomposition. This makes it possible to take early countermeasures against the abnormal turning of the shut-off member.

According to a thirteenth aspect of the present invention, the electric current flowing into the heater is intermittently controlled by the control means, based upon the temperatures detected by a heater temperature detector and a carrier temperature detector, such that the temperature lies within a preset range. That is, since the microorganism carrier is uniformly heated within a preset temperature range, conditions which are favorable for the microorganisms to exhibit decomposition action can be maintained and breeding of vermin in the microorganism carrier can be suppressed.

BRIEF DESCRIPTION OF THE DRAWINGS

The above object and features of the present invention will be more fully understood from the following description of the preferred embodiments when read in conjunction with the accompanying drawings, wherein:

FIGS. 9(A) and 9(B) illustrate the scattering angle of raw garbage pulverized by a rotary vane in the pulverizer unit of FIG. 3, wherein FIG. 9(A) illustrates the scattering angle in the vertical direction and FIG. 9(B) illustrates the scattering angle in the lateral direction;

DESCRIPTION OF THE PREFERRED EMBODIMENTS

A first embodiment of the present invention will now be described with reference to FIGS. 1 to 15.

Figure 1:
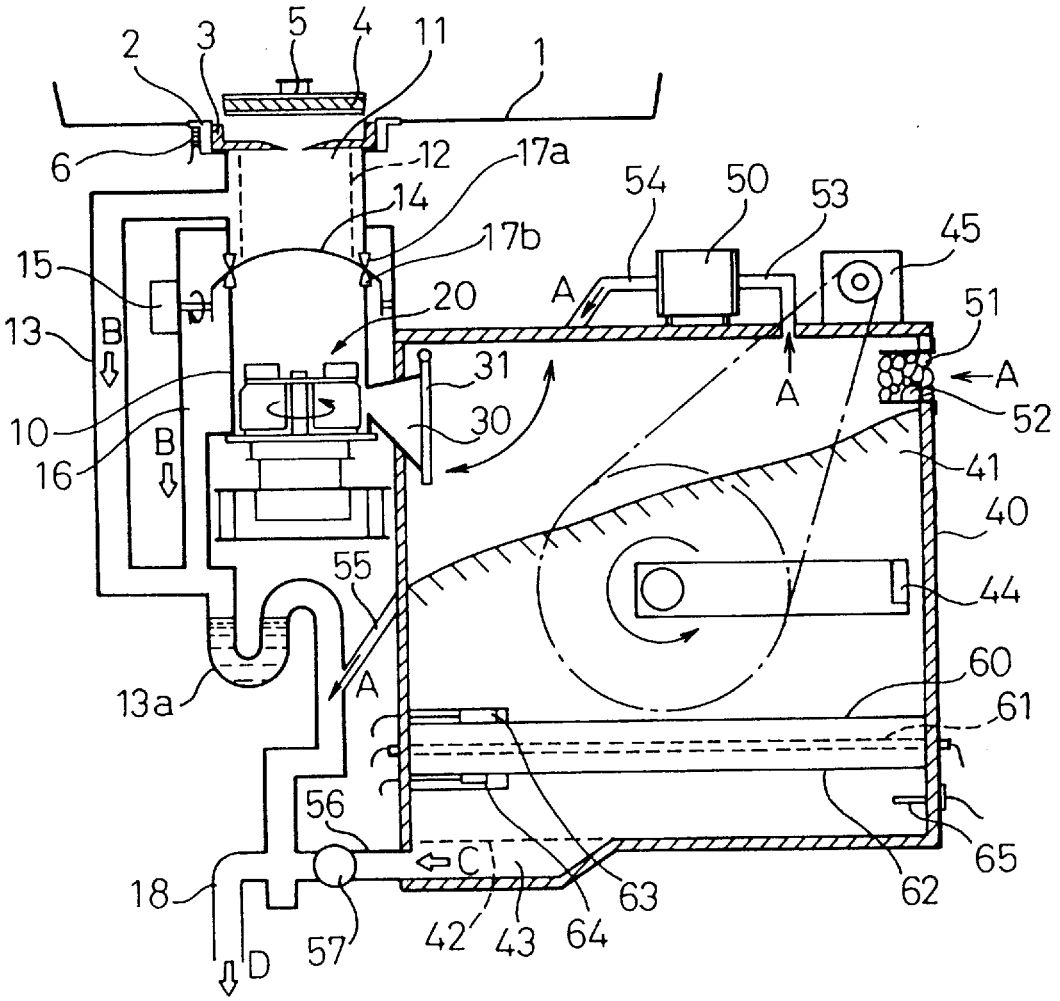
FIG. 1 is a vertical sectional view of an apparatus for treating raw garbage according to a first embodiment of the present invention.

FIG. 1 is a vertical sectional view illustrating an apparatus for treating raw garbage according to a first embodiment of the present invention. In FIG. 1, at a discharge port of a sink 1, there is provided a shielding cover 5 that is attached by a flange 2 to a throw port 11 through which raw garbage will be thrown as will be described later in detail, the shielding cover 5 having a magnet 4 that will be fitted to a baffle 3 which is incorporated inside the flange 2. Reference numeral 6 denotes a reed switch. When the shielding cover 5 is fitted to the baffle 3 so that the magnet 4 approaches the reed switch 6, the reed switch 6 is turned ON.

Reference numeral 10 denotes a pulverizer vessel which is a pulverizer unit. A throw port 11 for throwing the raw garbage is opened at an upper portion of the pulverizer vessel 6. Under the throw port 11, there is provided a filter member 12 which is a cylindrical water-draining unit made of punched metal having many drain holes or apertures (with a diameter of, for example, 1 mm) formed in the peripheral wall thereof. The side of the filter member 12 is coupled to a drainpipe 13 having a trap portion 13*a* through which will be discharged the water contained in the raw garbage and passed through the filter member 12. Under the filter member 12, there is provided a water-draining gate 14 which is an upwardly protruded spherical shut-off member. The water-draining gate 14 can be turned by a motor 15 into a gate-storing chamber 16 provided on the periphery of the pulverizing vessel 10 and can be stored therein. When the water-draining gate 14 is stored in the gate-storing chamber 16, the throw port 11 communicates with a pulverizer unit 20 that will be described later in more detail.

At the inlet of the gate-storing chamber 16 into which the water-draining gate 14 enters, there are provided an upper lip seal 17*a* of an annular shape made of rubber or the like, that is in contact with the upper surface of the water-draining gate 14 and a lower lip seal 17*b* of an annular shape made of rubber or the like that is in contact with the lower surface of the water-draining gate 14. Between the upper surface of the water-draining gate 14 and the upper lip seal 17*a* is formed a gap which permits the water contained in the raw garbage thrown through the throw port 11 to pass but does not permit raw garbage accumulated on the upper surface of the water-draining gate 14 to pass.

Reference numeral 18 denotes a discharge pipe which discharges into the sewage the drainage from the drainpipe 13 as well as decomposition gases and condensed water from a microorganism decomposition unit 40 that will be described later in more detail. A carrier duct 30 is provided to carry the dry-pulverized raw garbage into the microorganism decomposition unit 40 from the pulverizer unit 20 in the pulverizing vessel 10. The carrier duct 30 expands like a flaring part of a horn into the microorganism decomposition unit (hereinafter referred to as a microorganism decomposition chamber). At the blow-out port of the carrier duct 30, there is provided a cover 31 that opens when the pulverized raw garbage is to be conveyed.

Inside the microorganism decomposition chamber 40, a microorganism carrier 41, carrying aerobic bacteria that withstand high temperatures, is supported by a water-permeable support plate 42, while maintaining a gap 43. The water condensed from the microorganism carrier 41 during decomposition is stored in the gap 43 and is discharged through the discharge pipe 18. Reference numeral 44 denotes a stirrer vane that is driven to be rotated by a stirrer motor 45 to stir the microorganism carrier 41. A heater 60 that will be described later in more detail is provided at a position where it is not hit by the stirrer vane 44, for heating the microorganism carrier 41 to a predetermined temperature.

At an upper part of the microorganism decomposition chamber 40, there is provided an intake port 51 having a filter 52 composed of activated carbon or the like. By the operation of a ventilation pump 50, the external air is taken into the microorganism decomposition chamber 40 through the intake port 51 and the filter 52. A discharge pipe 55 is coupled between the downstream side of a trap portion 13*a* of the drainpipe 13 and the microorganism decomposition chamber 40 so as to suck and discharge decomposition gases generated in the microorganism decomposition chamber 40 via an intake pipe 53, ventilation pump 50 and blow-out pipe 54. The gap 43 at the lower part of the microorganism decomposition chamber 40 and the discharge pipe 18 are coupled through a coupling pipe 56, and a check valve 57 is installed in the coupling pipe 56 to prevent a counter flow from the discharge pipe 18 into the microorganism decomposition chamber 40.

The heater 60 provided under the microorganism decomposition chamber 40 is a double tube-type pipe heater comprising a rod-like sheathed or rod-like ceramic electric heater 61 contained in an outer cylinder 62. The heater 60 includes a heater temperature sensor 63 for detecting the temperature on the surface of the outer cylinder 62, a temperature fuse 64 that is blown when the temperature on the surface of the outer cylinder 62 exceeds a preset temperature, and a carrier temperature sensor 65 for detecting the temperature of the microorganism carrier 41. Being indirectly heated by the heater 60 via the outer cylinder 62 having a large surface area, the microorganism carrier 41 is heated to a temperature that kills vermin and their eggs but does not kill microorganisms, e.g., it is heated to 40° C. to 60° C.

Figure 2:
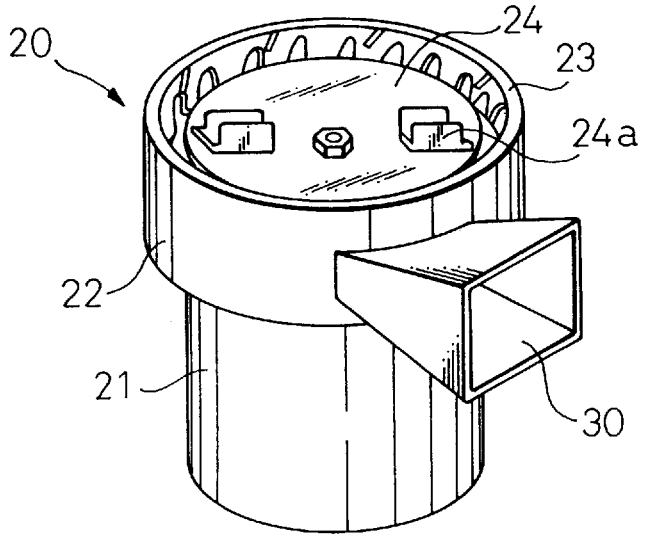
FIG. 2 is a perspective view of a pulverizer unit in the apparatus of FIG. 1.
Figure 3:
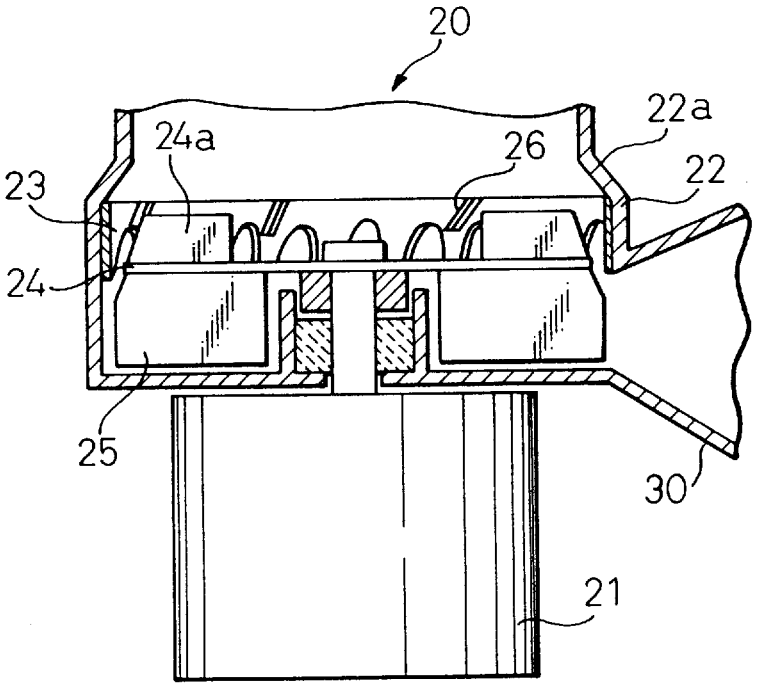
FIG. 3 is a vertical sectional view of the pulverizer unit in the apparatus of FIG. 1.

FIG. 2 is a perspective view of the pulverizing unit 20 and FIG. 3 is a vertical sectional view of the pulverizing unit 20. In FIGS. 2 and 3, reference numeral 21 denotes a pulverizer motor, and 22 denotes a cylindrical casing. At an upper part of fixed blades 23 in the casing 22 is formed a squeezing portion 22*a* that works to push down the pulverized raw garbage as will be described later in more detail. Reference numeral 24 denotes a disk-like pulverizer rotor provided with hammers 24*a* for pulverizing the raw garbage by impact. The pulverizer rotor 24 is disposed maintaining a predetermined gap from the cylindrical fixed blade 23, and is rotated by the pulverizer motor 21. The raw garbage coarsely pulverized by the hammers 24*a* is then finely pulverized by the shearing force of the fixed blades 23 as it passes through the above-mentioned gap.

Under the pulverizer rotor 24, there is mounted a rotary vane (hereinafter referred to as an impeller) 25 which rotates while interlocking with the pulverizer rotor 24. The pulverized raw garbage falling through the gap between the fixed blades 23 and the pulverizer rotor 24 is impelled by the impeller 25 into the microorganism decomposition chamber 40 via a carrier duct 30 that will be described later in more detail. On the casing 22 facing the outer periphery of the impeller 25, there is mounted the carrier duct 30 that expands like a flaring part of a horn toward the microorganism decomposition chamber 40. On the inner wall of the fixed blade 23 there are provided a plurality of protruded guide plates 26 which are inclined by a predetermined angle and are spaced from each other by an approximately equal distance in order to downwardly push the pulverized raw garbage as will be described later in more detail.

Next, described below is the operation of this embodiment. Referring to FIG. 1, when a stirrer switch that is not shown in the figure is turned ON, the stirrer motor 45 rotates the stirrer vane 44 so that the microorganism carrier 41 is stirred by the stirrer vane 44. Then, when a ventilation switch that is not shown in the figure is turned ON, the ventilation pump 50 is actuated to introduce the external air from the intake port 51 through the filter 52, and the external air is sucked by the intake pipe 53 and exhausted into the drainpipe 13 passing through the blow-out pipe 54 along the outer side of the microorganism decomposition chamber 40 and through the discharge pipe 55, as indicated by arrows A. Therefore, the interior of the microorganism decomposition chamber 40 is ventilated at all times. Further, when a heater switch that is not shown in the figure is turned ON, electric current flows into the electric heater 61 so that the heater unit 60 generates heat. Accordingly, the microorganism carrier 41 is heated and is maintained at a predetermined vermin-killing temperature, for example, at 40° C. to 60° C. by a control circuit that is not shown in the figure, based on the temperatures detected by the temperature sensors 63 and 65.

Next, the shielding cover 5 of the sink 1 is opened and raw garbage containing water is thrown through the throw port 11. The raw garbage is accumulated on the upper spherical surface of the water-draining gate 14. The water contained in the accumulated raw garbage is collected in the circumferential direction along the water-draining gate 14 of a spherical shape. Most of the water contained in the raw garbage passes through apertures formed in the filter member 12 and is drained into the drainpipe 13. The remaining contained water flows along the upper surface of the water-draining gate 14, enters into the gate-storing chamber 16 through the gap between the water-draining gate 14 and the upper lip seal 17*a*, and is drained into the drainpipe 13 from the lower side of the gate-storing chamber 16. Therefore, the water contained in the raw garbage accumulated on the water-draining gate 14 is sufficiently drained into the drainpipe 13; i.e., pulverized fine raw garbage does not infiltrate into the drainage and the quality of the drainage is favorably maintained.

While the water is being drained from the raw garbage, the water-draining gate 14 is kept closed so that the passage between the filter member 12 and the pulverizing rotor 24 is shut off. This makes it possible to prevent the water from flowing into the pulverizing vessel 10 and, hence, to prevent the raw garbage from containing large amounts of water from entering the pulverizer vessel 10 as will be described later in more detail.

After the raw garbage has entered the pulverizing vessel 10, and when the shielding cover 5 is closed, the reed switch 46 is turned ON. Then, when a foot switch (not shown) is turned ON, the motor 15 turns the water-draining gate 14 so as to be stored in the gate-storing chamber 16. Then, a pulverizer switch (not shown) is closed to rotate the pulverizer motor 21 shown in FIG. 3 so that the pulverizer rotor 24 is driven to be rotated.

In the step of turning the water-draining gate 14, the raw garbage accumulated on the upper surface of the water-draining gate 14 is scrapped off by the upper lip seal 17*a* and, hence, does not infiltrate into the gate-storing chamber 16; i.e., the raw garbage after drained falls down onto the lower pulverizer unit 20 as the water-draining gate 14 is turned open. At this time, since the shielding cover 5 closes the throw port 11, the raw garbage containing water is not directly thrown into the pulverizer unit 20 through the throw port 11. Therefore, raw garbage containing water is never wet-pulverized in the pulverizer unit 20 and the raw garbage containing large amounts of water is never carried into the microorganism decomposition chamber 40. As a result, the ability of decomposition of the microorganisms is not lowered.

The drained raw garbage which has fallen on the pulverizer unit 20 as the water-draining gate 14 is turned open is coarsely pulverized by the impact of the hammers 24*a* that are rotating as shown in FIG. 3, and is finely pulverized by the shearing force of the fixed blades 23 as the garbage passes through the gap between the fixed blades 23 and the pulverizer rotor 24. By the guide plates 26 which are provided on the inner wall of the fixed blades 23 with an inclination of a predetermined angle, and by the squeezing portion 22*a* of the casing 22 formed at an upper portion of the fixed blade 23, the pulverized raw garbage accumulated on the pulverizer rotor 24 is pushed down through the above-mentioned gap and is blown through the carrier duct 30 into the microorganism decomposition chamber 40 due to the impeller 25 that is rotating.

Referring to FIG. 1, the drained and pulverized raw garbage conveyed into the microorganism decomposition chamber 40 is decomposed by microorganisms in the microorganism carrier 41 to form decomposition gases ($CO_2$ and $H_2O$). The decomposition gases are discharged into the drainpipe 13 together with the external air that flows through the space in the microorganism decomposition chamber 40, due to the ventilation pump 50, as indicated by the arrows A. The mixture of the decomposition gases and the external air are discharged into the sewage or the like through the discharge pipe 18 as indicated by an arrow D together with the drainage drained through the drainpipe 13 as indicated by an arrow B and condensed water in the microorganism carrier 41 drained from the gap 43 through a coupling pipe 56 as indicated by an arrow C. Accordingly, smooth ventilation is accomplished in the microorganism decomposition chamber 40.

Here, the microorganism carrier 41 is heated by the heater 60 to, for example, 40° C. to 60° C. at which vermin and their eggs are killed but microorganisms are not killed. Therefore, breeding of vermin in the microorganism carrier 41 is suppressed, and vermin do not emerge into the sink 1 from the microorganism decomposition chamber 40 when the shielding cover 5 is opened to throw raw garbage.

Furthermore, by the check valve 57 installed in the coupling pipe 56 that couples the lower gap 43 of the microorganism decomposition chamber 40 to the discharge pipe 18, the drainage and decomposition gases are prevented from flowing back into the microorganism decomposition chamber 40 from the discharge pipe 18. Accordingly, the ability of decomposition of microorganisms is not lowered in the microorganism decomposition chamber 40. Still further, by the trap portion 13*a* installed in the drainpipe 13, the decomposition gases drained into the drainpipe 13 via the discharge pipe 55 are prevented from flowing back to the pulverizer vessel 10 through the drainpipe 13.

Figure 4:
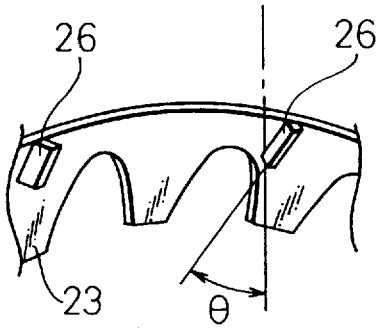
FIG. 4 is a perspective view of a guide plate in the pulverizer unit of FIG. 3.
Figure 5:
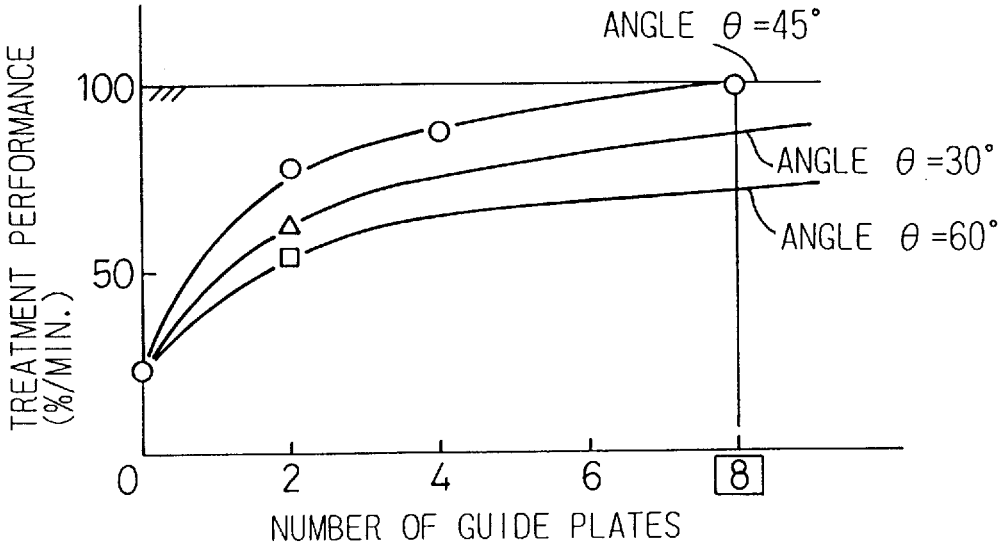
FIG. 5 is a diagram illustrating a relationship between the angle of inclination of the guide plate of FIG. 4 and the performance of treating raw garbage.

FIG. 4 illustrates the angle θ of inclination of the guide plates 26 mounted on the inner wall of the fixed blade 23 and the number of guide plates 26, and FIG. 5 shows the tested results of treatment of standard raw garbage (60% of vegetables, 20% of grains, 10% of fruits and 10% of meat on the weight basis). Here, the treatment is expressed by the following formula, $$\text{Treatment} = \{\text{Amount carried in a minute (g/min.)}/\text{Amount thrown for one meal (340 g)}\} \times 100(\%/\text{min})$$

As will be apparent from FIG. 5, it was confirmed that the highest treatment performance is obtained when the angle θ of inclination of the guide plates 26 is about 45 degrees and the number of the guide plates 26 is eight.

Figure 6:
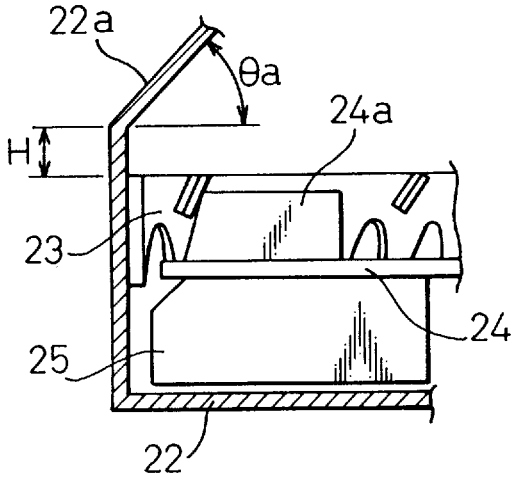
FIG. 6 is a vertical sectional view of a squeezing portion in the pulverizer unit of FIG. 3.
Figure 7:
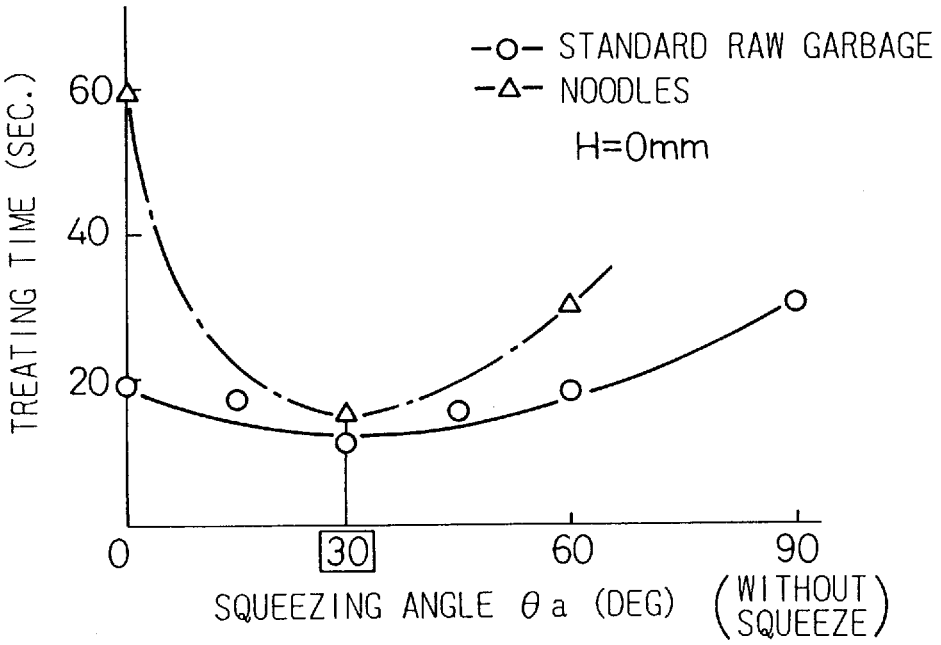
FIG. 7 is a diagram illustrating a relationship between the squeezing angle of the squeezing portion of FIG. 6 and the time for treating raw garbage.
Figure 8:
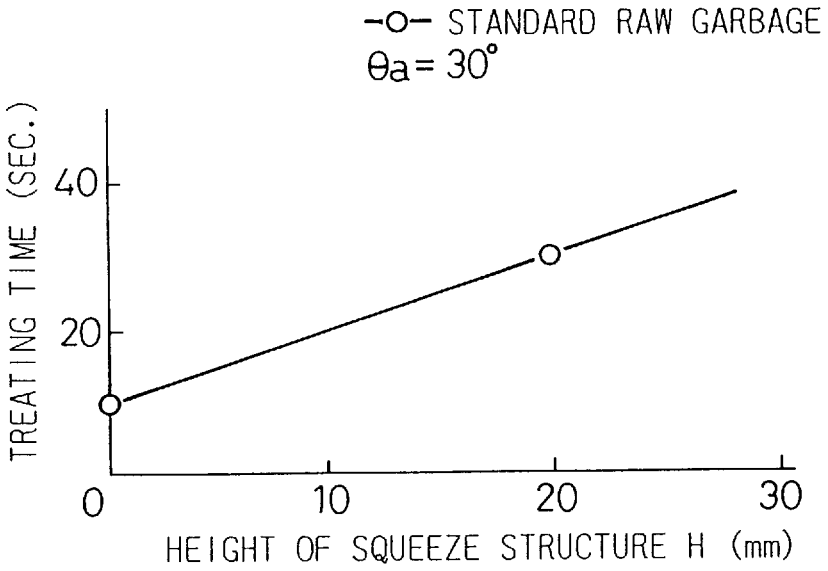
FIG. 8 is a diagram illustrating a relationship between the height of squeeze structure in the squeezing portion of FIG. 6 and the time for treating raw garbage.

FIG. 6 illustrates the squeezing angle θ of the squeezing portion 22*a* of the casing 22, and FIG. 7 illustrates the test results of treating time of standard raw garbage and noodles when the height of the squeeze structure is 0 mm as will be described later in more detail. FIG. 8 illustrates the test results of treating time of standard raw garbage when the squeezing angle is 30 degrees while changing the height H of the squeeze structure from the fixed blade 23 to the squeezing portion 22*a* as shown in FIG. 6.

As will be apparent from FIG. 7, it was confirmed that the treating time was the shortest when the squeezing angle θa of the squeezing portion 22*a* was about 30 degrees. In the case of treating viscous materials such as noodles, it was confirmed that the treating time was greatly lengthened unless the squeezing angle θa was imparted. As will be apparent from FIG. 8, furthermore, it was confirmed that the smaller the height H of the squeeze structure, the shorter the treating time.

Figure 9A:
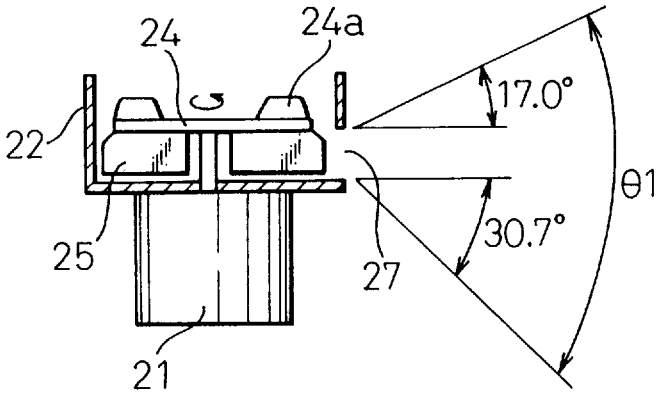
Figure 9B:
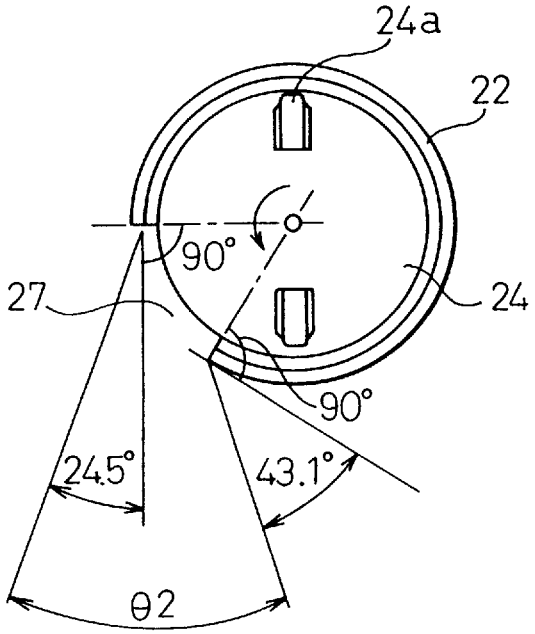

FIGS. 9(A) and 9(B) illustrate the angle of scattering the dry-pulverized raw garbage by the impeller 25, wherein θ1 in FIG. 9(A) represents the scattering angle in the vertical direction and θ2 in FIG. 9(B) represents the scattering angle in the lateral direction. In the experiment, the impeller 25 was turned at a speed of 1750 revolutions/minute, and the angle of vanes relative to the central direction of the impeller 25 was 45 degrees.

As shown in FIG. 9(A), it was confirmed that the scattering angle θ1 of the pulverized raw garbage in the vertical direction was 17.0° in the upper direction from the upper end of a garbage blow-out port 27 of the casing 22 and was 30.7° in the lower direction from the lower end of the blow-out port 27. As shown in FIG. 9(B), on the other hand, it was confirmed that the scattering angle θ2 of the pulverized raw garbage in the lateral direction was an angle between a line which makes an angle of 43.1° with the tangential direction on the left side thereof and at an end of the blow-out port 27 in the rotating direction of the pulverizer rotor 24, and a line which is 24.5° on the left side of the tangential direction at another end of the blow-out port 27.

As described above, the carrier duct 30 expands toward the microorganism decomposition chamber 40. Therefore, even when the fluidity of the pulverized raw garbage is poor, the pulverized raw garbage may still be scattered; i.e., the pulverized raw garbage is not clogged in the carrier duct 30 so that it is conveyed into the microorganism decomposition chamber 40 without interruption. Thus, the pulverized raw garbage is smoothly conveyed into the microorganism decomposition chamber 40. In particular, when the carrier duct 30 expands like a flaring part of a horn toward the microorganism decomposition chamber 40 at angles of not smaller than θ1 in the vertical direction and not smaller than θ2 in the lateral direction, the pulverized raw garbage is not prevented from scattering. Therefore, the pulverized raw garbage is not clogged in the carrier duct 30 and is conveyed to the microorganism decomposition chamber 40 without interruption.

Described below are principal control operations according to this embodiment.

Controlling the Pulverization and Ventilation

Figure 10:
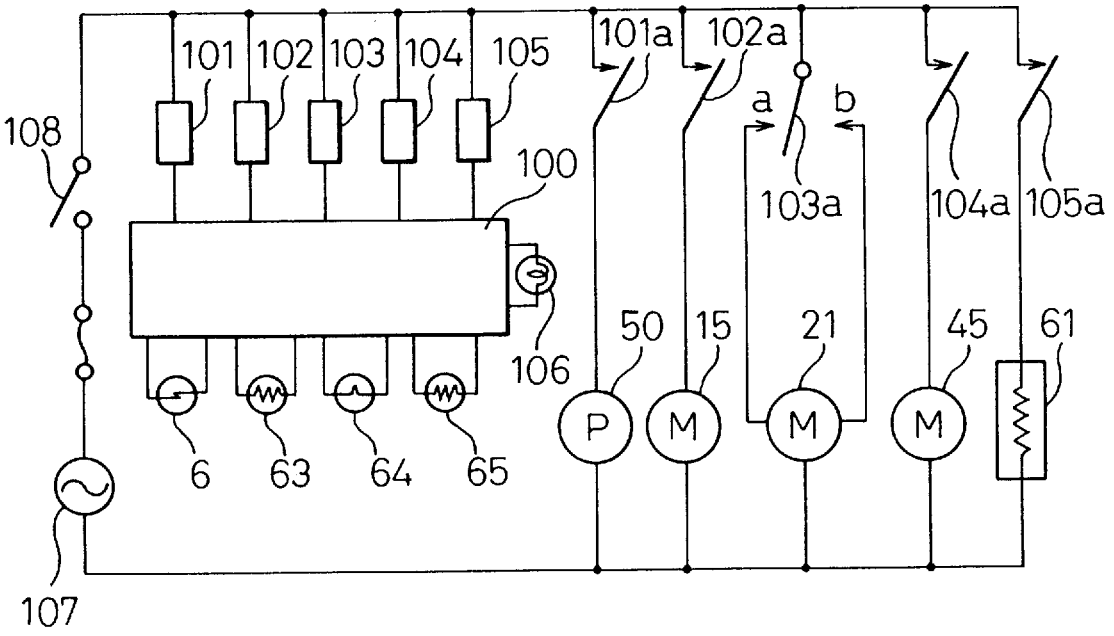
FIG. 10 is a diagram of an electric circuit of a major portion concerned with a main control operation.
Figure 11:
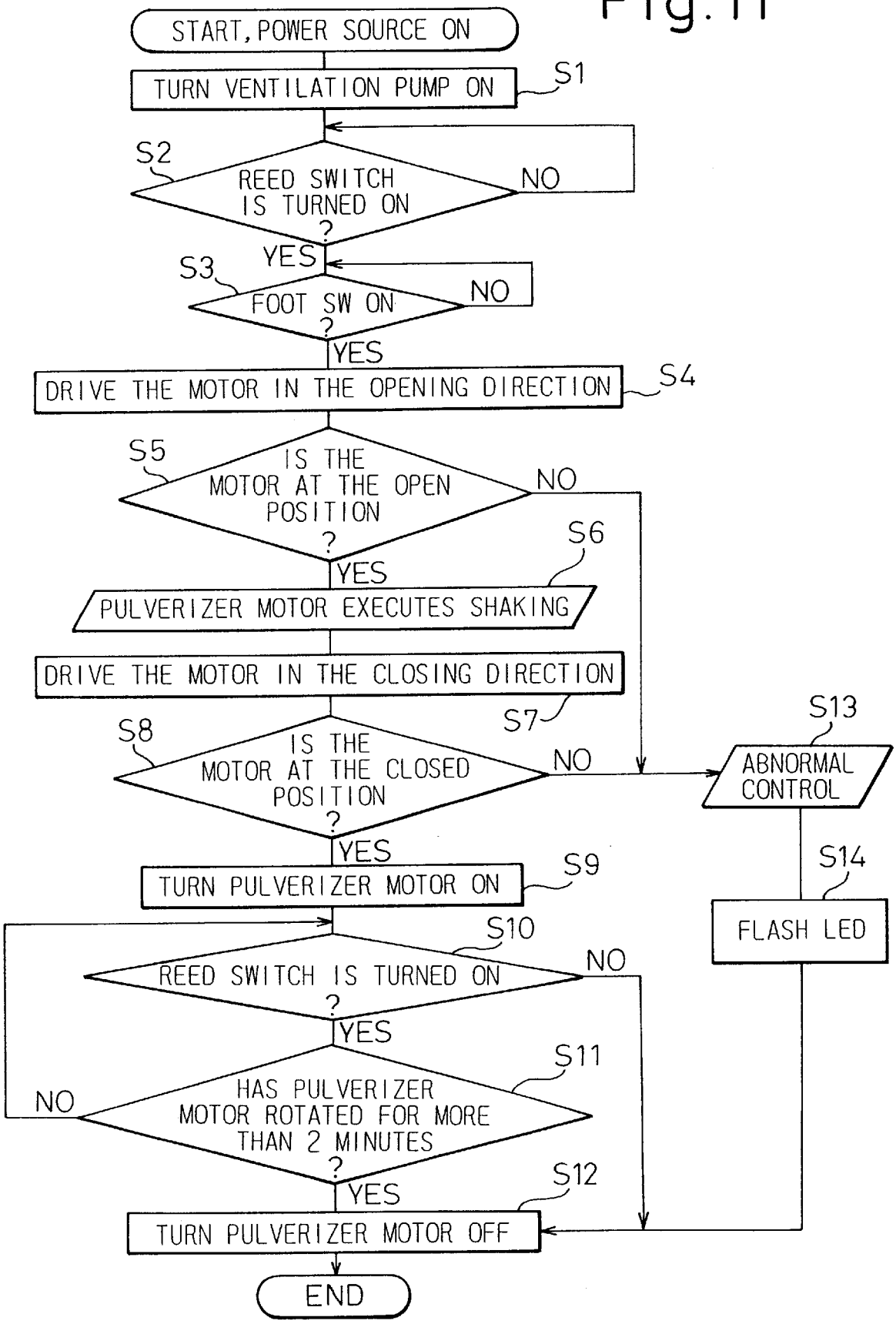
FIG. 11 is a flow chart of operation for controlling pulverization and ventilation.

First, controlling the pulverization and ventilation will be described with reference to FIGS. 10 to 13. Referring to FIG. 10, when a power switch 108 connected to a power source 107 is turned ON, a control circuit 100 executes a control operation in compliance with a flow chart shown in FIG. 11. First, a current flows into a relay 101 whereby a contact 101*a* is closed and the ventilation pump 50 is actuated to execute the ventilation in the microorganism decomposition chamber 40 (step S1).

Then, it is determined whether or not the reed switch 6 is turned ON (step S2). When the reed switch 6 is turned ON, the interlock is released. Then at a step S3, when a foot switch (not shown) is turned ON, the current flows to a relay 102 whereby a contact 102*a* is closed, and the motor 15 rotates in a direction to open the water-draining gate 14 (step S4). It is then determined whether the motor 15 is at the open position (step S5). When it is at the open position, the shaking operation is carried out (step S6) as will be described later. After the shaking operation is finished, the motor 15 is turned in a direction to close the water-draining gate 14 (step S7).

It is then determined whether the motor 15 is at the closed position or not (step S8). When it is at the closed position, the current is supplied to the relay 103 whereby a contact 103*a* connects to the side a for forward rotation, and the pulverizer motor 21 rotates the pulverizer rotor 24 (step S9). It is determined whether or not the reed switch 6 is turned on (step S10). When it is turned on, it is determined whether the pulverizer motor 21 has rotated for more than two minutes (step S1). When it has rotated for more than two minutes, the electric current to the relay 103 is interrupted so that the contact 103*a* is opened to stop the rotation of the pulverizer motor 21 (step S12).

When the motor 15 is not at the open position at the step S5 or is not at the closed position at the step S8, it is regarded that the water-draining gate 14 is turned abnormally and abnormal control is assumed (step S13), whereby an LED 16 flashes to generate an abnormal signal (step S14) and, at the same time, the program proceeds to the step S12 to stop the rotation of the pulverizer motor 21. When the reed switch 6 is not turned ON at the step S10, it means that the shielding cover 5 is opened. Therefore, the program proceeds to the step S12 to stop the rotation of the pulverizer motor 21. When the pulverizer motor 21 is not rotating for more than two minutes at the step S11, the program returns back to the step S10 to repeat the operation. In the above-mentioned control operation, when the shielding cover 5 is opened to turn OFF the reed switch 6, the relays 102 and 103 are turned OFF by the control circuit 100 to stop the motor 15 and the pulverizer motor 21.

Figure 12:
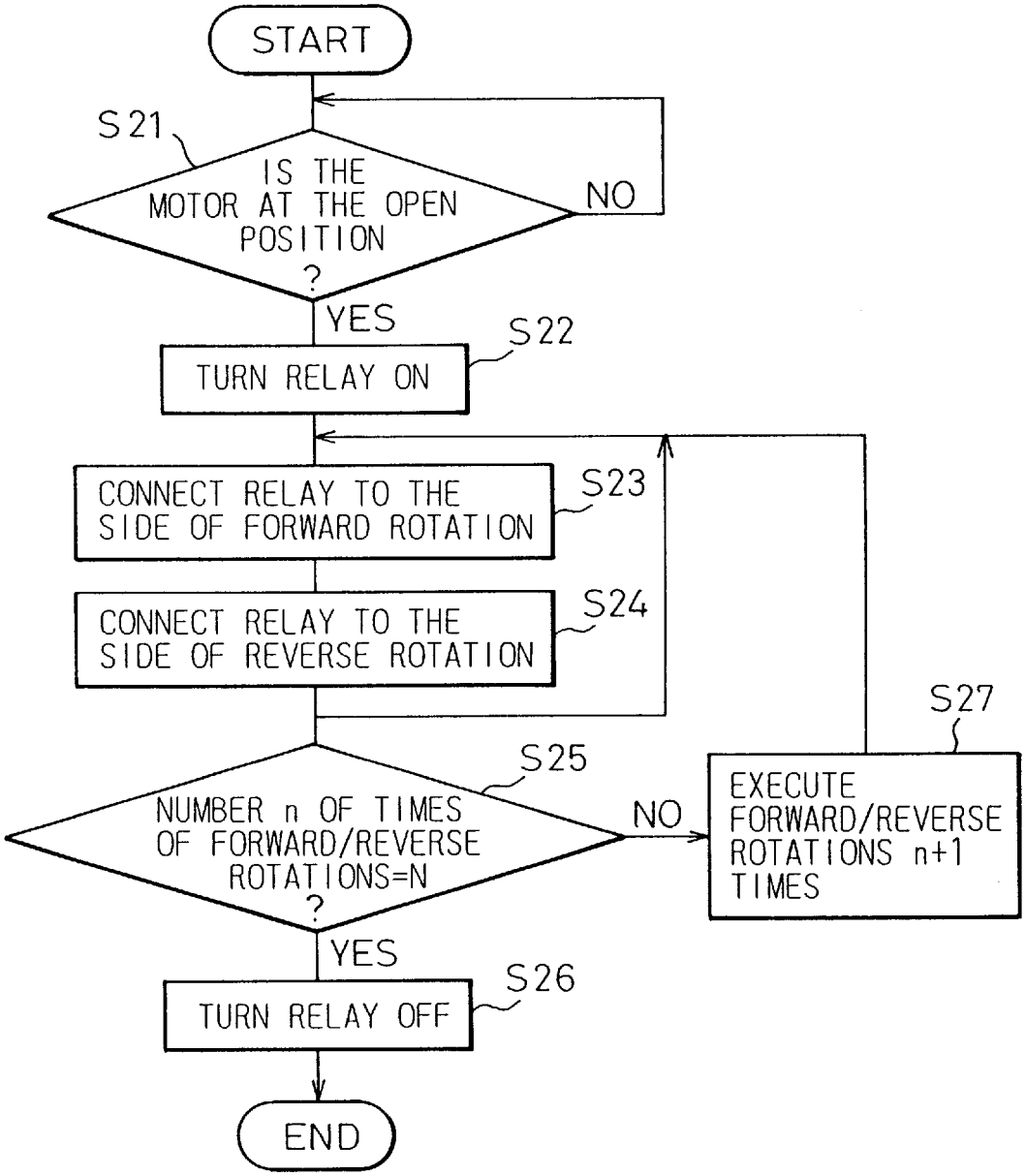
FIG. 12 is a flow chart of the operation for controlling the shaking.

The shaking operation at the step S6 is executed by the control circuit 100 in accordance with a flow chart shown in FIG. 12. It is first determined whether or not the motor 15 is at the open position where the water-draining gate 14 is being opened (step S21). When the motor 15 is at the open position, a current flows into the relay 103 (step S22) whereby the contact 103*a* connects to the side a of forward rotation, and the pulverizer motor 21 rotates in the forward direction (step S23). Then, the switch contact 103*a* connects to the side b for reverse rotation and the pulverizer motor 21 rotates in the reverse direction (step S24). Thus, the above-mentioned forward rotation and reverse rotation are repeated. It is determined whether the number n of times of forward and reverse rotations is N (step S25). When the operations are repeated N times, the current to the relay 103 is interrupted (step S26), so that the switch contact 103*a* is opened to stop the pulverizer motor 21.

When the number n of times of forward/reverse rotations is smaller than N at the step S25, the forward/reverse rotations are executed n+1 times (step S27), and the program returns back to the step S23 to repeat the above operation. The forward rotation and reverse rotation of the pulverizer motor 21 are executed at a frequency of, for example, 0.5 seconds, and are repeated N times which is, for example, ten times. The pulverizer rotor 24 rotates in the forward and reverse directions while interlocked with the pulverizer motor 21 that rotates in the forward and reverse directions. Therefore, the raw garbage from which water is drained off falls and accumulates on the pulverizer rotor 24 and is shaken to become flat. Accordingly, the raw garbage from which water has been drained off and accumulated on the pulverizer rotor 24 does not hinder the turning of the water-draining gate 14.

Figure 13:
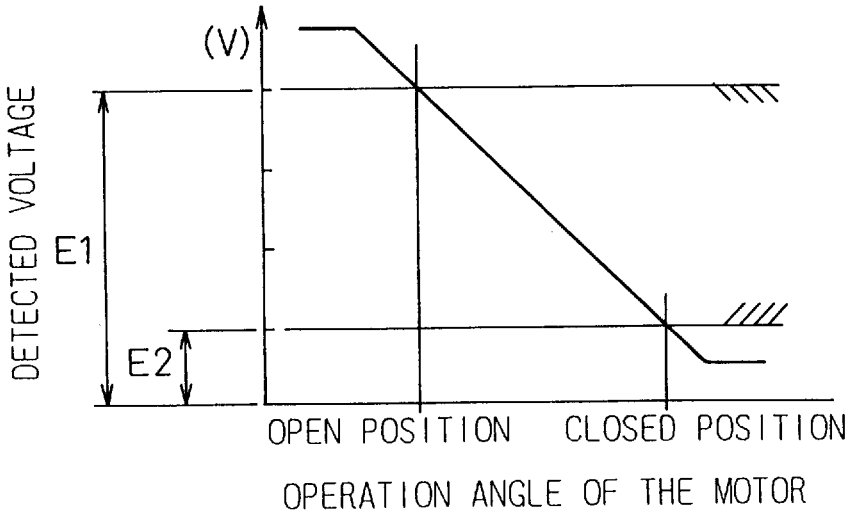
FIG. 13 is a diagram illustrating a relationship between the operation angle of the motor and the detected voltage.

FIG. 13 illustrates a relationship between the detected voltage and the operation angle of the motor 15 of the water-draining gate 14. In this case, a position sensor (not shown) is contained in a rotary shaft of the motor 15, and displacement of the position sensor is converted into a change in output voltage which is then detected. Under the normal condition, the detected voltage is not smaller than El when the operating angle of the motor 15 is at the open position (the water-draining gate is determined to have been opened when the voltage is larger than E1), and the detected voltage is not larger than E2 when the operation angle of the motor 15 is at the closed position (the water-draining gate is determined to have been closed when the voltage is not larger than E2). When the detected voltage is not larger than E1 at the open position and is not smaller than E2 at the closed position, it is regarded that the water-draining gate 14 is not turned up to a predetermined position, and the above-mentioned abnormal control is executed. This may happen when, for example, the gate is jammed.

Accordingly, the pulverizer motor 21 ceases to operate, the pulverizer rotor 24 ceases to operate, and LED 106 flashes to indicate abnormal signals. Therefore, it does not happen that the water is insufficiently drained from the raw garbage due to abnormal turning of the water-draining gate 14, and drainage from a kitchen is directly conveyed into the microorganism decomposition chamber 40. Accordingly, the quality of the drainage is not deteriorated, the ability of decomposition by microorganisms is not lowered, and a countermeasure can be quickly taken against abnormal turning of the water-draining gate 14.

Controlling the Temperature and Stirring

Figure 14:
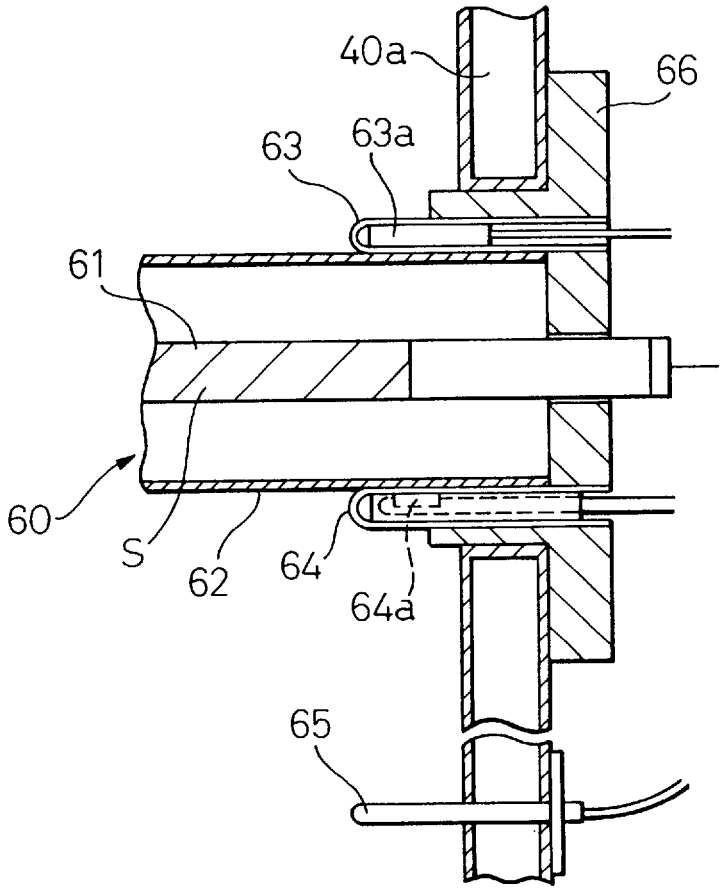
FIG. 14 is a vertical sectional view illustrating the constitution of a temperature-adjusting unit.

The operation for controlling the temperature and stirring is described below with reference to FIGS. 10, 14 and 15. Referring to FIG. 14, a heater temperature sensor 63 containing a temperature element 63*a* and a temperature fuse 64 containing a fuse element 64*a* are attached, via a holder 66, to a heat-insulating wall 40*a* that constitutes the casing of the microorganism decomposition chamber 40, the temperature element 63*a* and the fuse element 64*a* contacting with the surface of the outer cylinder 62 of the heater 60. On the other hand, a carrier temperature sensor 65 is attached to another plate of the heat-insulating wall 40*a*. The positions of the temperature element 63*a* and fuse element 64*a* are determined in such a way that the temperature on the surface of the outer cylinder 62 can be detected at a position corresponding to an effective heat-generating portion S of the rod-type electric heater (hereinafter referred to as a heater) provided inside the outer cylinder 62.

Figure 15:
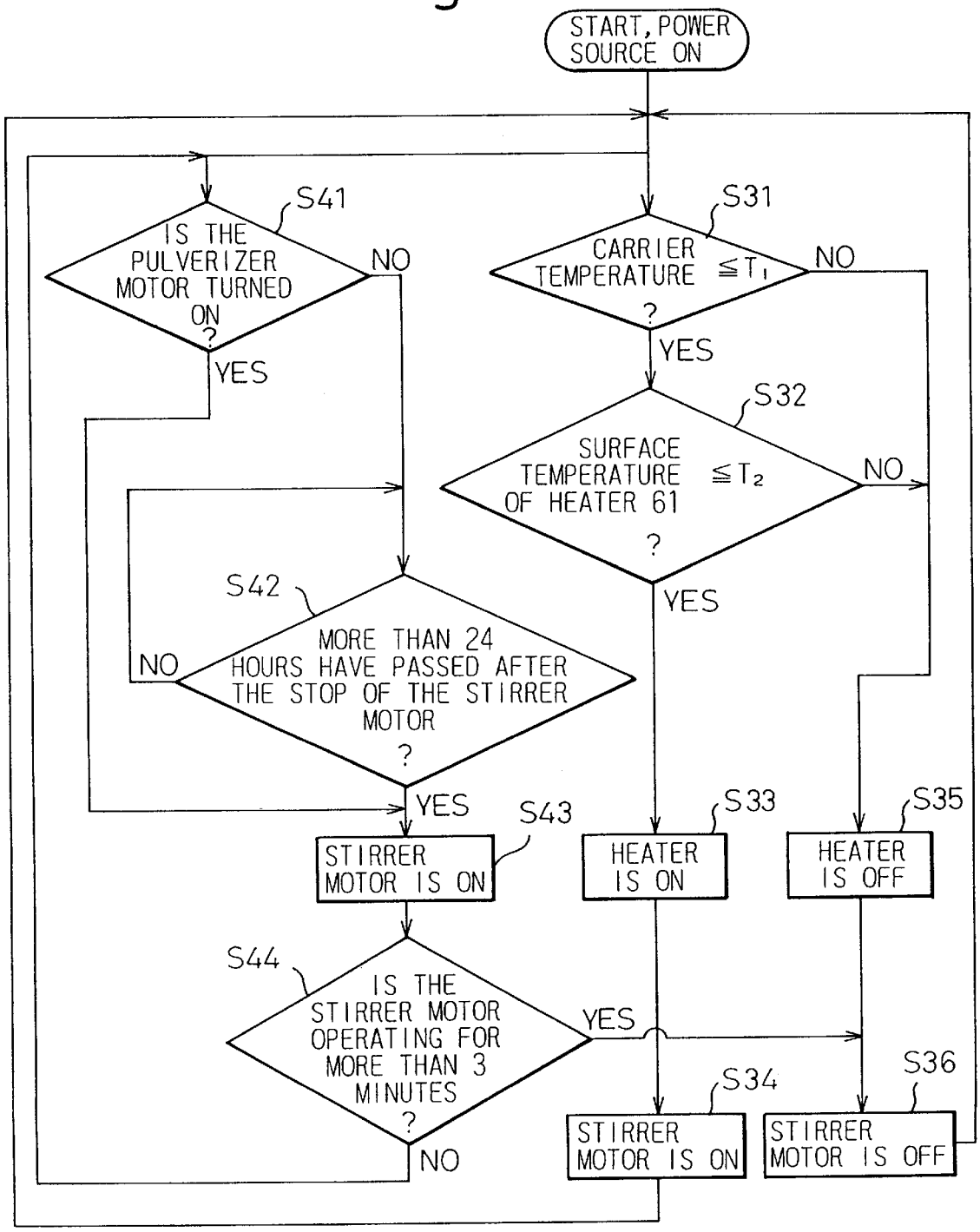
FIG. 15 is a flow chart of the operation for controlling the temperature and stirring.

Referring to FIG. 10, when the power switch 108 is turned ON, the control circuit 100 executes the control operation in accordance with a flow chart shown in FIG. 15. First, it is determined by the carrier temperature sensor 65 whether or not the temperature of the microorganism carrier 41 is a predetermined temperature $T_1$, (for example, 40° C. to 60° C.) or less (step S31). When the temperature of the microorganism carrier 41 is the predetermined temperature $T_1$, it is then determined by the heater temperature sensor whether or not the surface temperature of the heater 61 is a predetermined temperature $T_2$ (for example, from 70° C. to 80° C.) or less (step S32). When the surface temperature of the heater 61 is the predetermined temperature $T_2$ or less, a current flows into a relay 105 to close a contact 105*a*, resulting in a current that flows into the heater 61 (step S33) whereby the heater 61 heats the microorganism carrier 41.

At the same time, a current flows to a relay 104 to close a contact 104*a* so that the stirrer motor 45 rotates (step S34) and drives the stirrer vane 44 to rotate so as to stir the microorganism carrier 41. At the step S31, when the temperature of the microorganism carrier 41 is higher than the predetermined temperature $T_1$, and at the step S32, when the surface temperature of the heater 61 is higher than the predetermined temperature $T_2$, no current flows to the relay 105 (step S35) so that the contact 104*a* is kept to be opened, and the stirrer motor 45 is in a stopped state (step S36).

On the other hand, by turning ON the power switch 108, it is determined whether or not the pulverizer motor 21 is in operation (step S41). When the pulverizer motor 21 is in operation, the program proceeds to a step S42 where it is determined whether more than 24 hours have passed after the stop of the stirrer motor 45 (step S42). When more than 24 hours have passed, a current is supplied to the relay 104 and the contact 104*a* is closed so that the stirrer motor 45 operates (step S43). It is then determined whether or not the stirrer motor 45 has operated for more than three minutes (step S44). When it has operated for more than three minutes, the program proceeds to a step S36 where the stirrer motor 45 comes to a halt. When the stirrer motor 45 has not operated for more than three minutes, the program returns back to the step S41 to repeat the operation.

As described above, the microorganism carrier 41 is stirred by the stirrer vane 44 that is rotated by the stirrer motor 45 and the current is intermittently supplied to the heater 61 in accordance with the temperatures detected by the heater temperature sensor 63 and the carrier temperature sensor 65, so that the temperature lies within a preset range. Therefore, the microorganism carrier 41 is uniformly heated to within the preset temperature range, an oxygen-rich condition is maintained in which microorganisms exhibit promoted action of decomposition, and the breeding of vermin is suppressed in the microorganism carrier 41.

When the temperature control operation becomes abnormal and the temperature of the heater 61 rises abnormally, the temperature fuse mounted on the surface of the outer cylinder 62 is blown so that a current to the relay 105 is interrupted, the contact 105*a* is opened, the current to the heater 61 is interrupted, the inflammable microorganism carrier 41 is not heated any more, and the safety of the apparatus is maintained.

Figure 16:
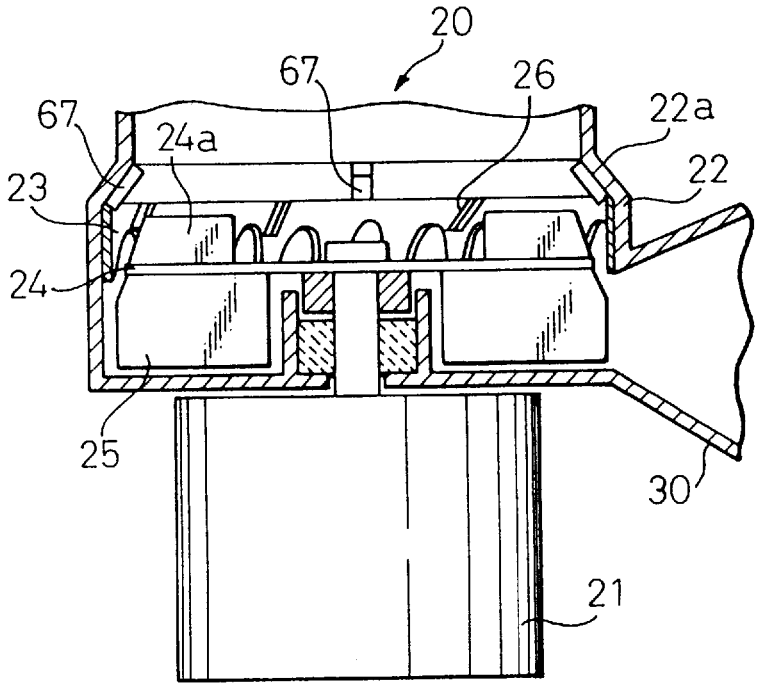
FIG. 16 is a vertical sectional view of the pulverization unit according to a second embodiment of the present invention.

A second embodiment will be described next with reference to FIG. 16.

On the inner wall surface of the squeezing portion 22*a* of the casing 22 of the pulverizer unit 20, there are formed rectangular protruded portions 67 as a unitary structure with the casing 22. Here, the protruded portions 67 have a thickness that withstands the impact force that is produced when the thrown raw garbage collides with the protruded portions 67. By providing the protruded portions 67 on the inner surface of the squeezing portion 22*a*, the masses of raw garbage on the hammers 24*a* can collide with the protruded portions 67 to effect coarse pulverization. Thus, the raw garbage can be favorably pulverized. Since the raw garbage is favorably pulverized, the load exerted on the pulverizer rotor 24 can be decreased and, hence, an increase in a current flow into the pulverizer motor 21 and a locked state of the pulverizer motor 21 can be prevented.

The constitution and operation in other respects are the same as those of the first embodiment so that the description thereof is omitted.

A third embodiment will be described next with reference to FIG. 17.

In the first embodiment, the heater for maintaining the microorganism carrier at a constant temperature is provided in the lower part of the microorganism decomposition chamber, so that the heater is in direct contact with the microorganism carrier. It is, however, also permissible to employ the following structure.

Figure 17:
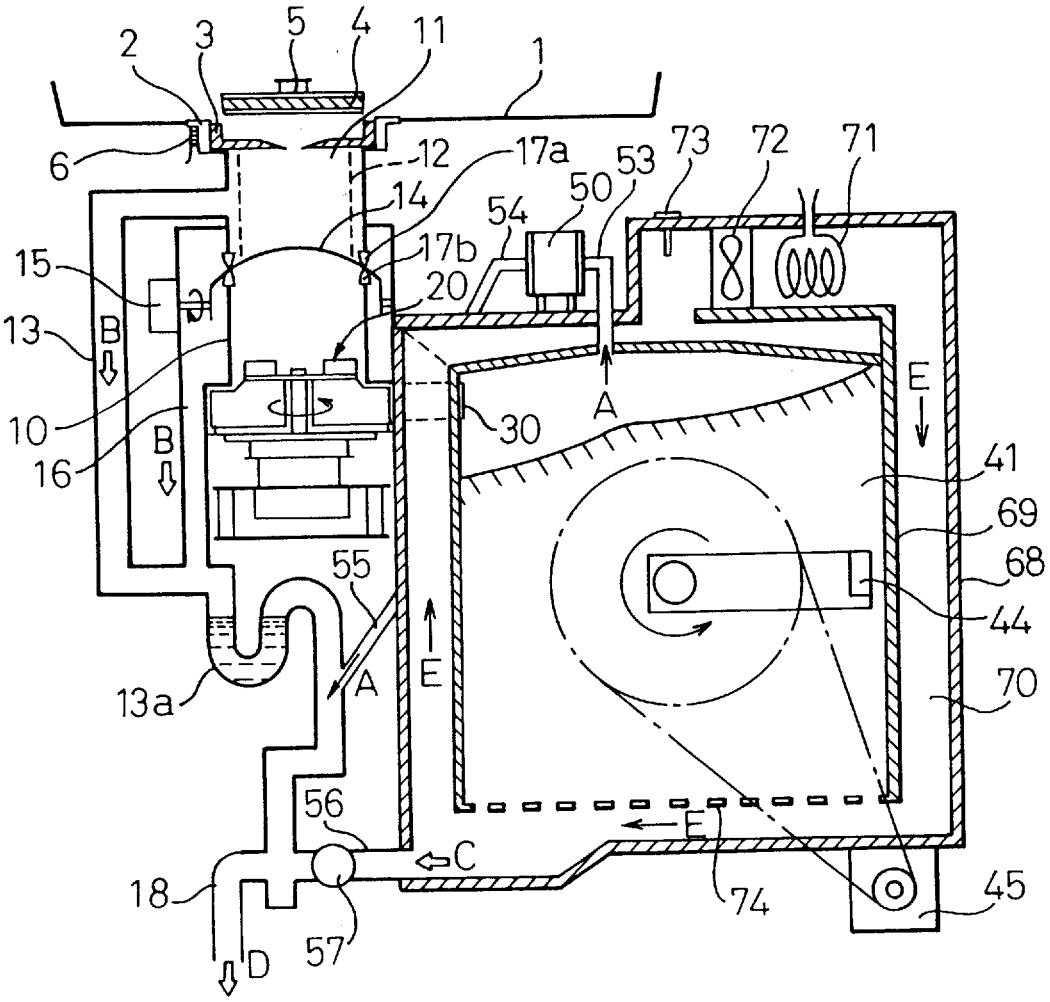
FIG. 17 is a vertical sectional view of the apparatus for treating raw garbage according to a third embodiment of the present invention.

Referring to FIG. 17, a microorganism decomposition chamber 69 containing therein a microorganism carrier 41 is accommodated in a housing 68 made of a heat-insulating material, and a ventilation conduit 70 is formed surrounding the microorganism decomposition chamber 69. The lower portion of the housing 68 is communicated with the discharge pipe 18 via the check valve 57.

A heater 71 and a fan 72 are installed in the ventilation conduit 70. By actuating the fan 72, the air heated by the heater 71 circulates through the ventilation conduit 70 as indicated by an arrow E. As the air heated by the heater 71 circulates through the ventilation conduit 70, the microorganism decomposition chamber 69 is heated. In the ventilation conduit 70, there is provided a temperature sensor 73 for detecting the temperature of the air that passes through the ventilation conduit 70. The heater 71 is controlled depending upon the temperature detected by the temperature sensor 73, so that the microorganism carrier 41 in the microorganism decomposition chamber 69 is maintained at a predetermined temperature (e.g., 40° C. to 60° C.).

As described above, the temperature of the microorganism carrier 41 in the microorganism decomposition chamber 69 is adjusted by the air that is heated by the heater 71 and that passes through the ventilation conduit 70 provided surrounding the microorganism decomposition chamber 69, whereby it becomes possible to decrease the region that is not stirred by the stirrer vane 44 in the microorganism decomposition chamber 69. Accordingly, the microorganism carrier 41 can be uniformly stirred by the stirrer vane 44 so that it is possible to enhance ability for decomposing raw garbage by microorganisms.

The bottom surface 74 of the microorganism decomposition chamber 69 is made of a punched metal, and the condensed water formed in the step of decomposition of raw garbage by microorganisms drops down on the bottom of the housing 68. The condensed water stored on the bottom of the housing 68 is drained into the discharge pipe 18 through the check valve 57.

The constitution and operation in other respects are the same as those of the first embodiment so that the description thereof is omitted.

Figure 18:
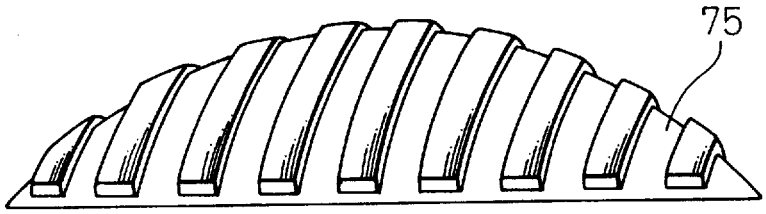
FIG. 18 is a perspective view of a water-draining gate according to a fourth embodiment of the present invention.
Figure 19:
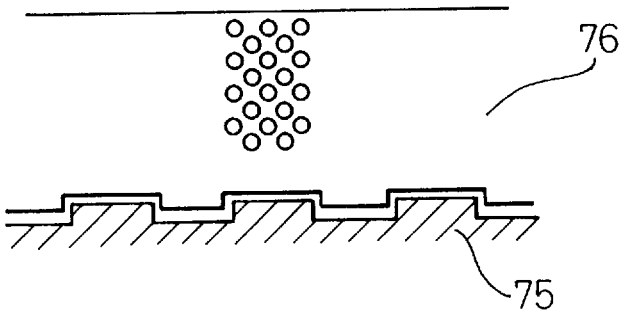
FIG. 19 is a diagram illustrating the surface of the water-draining gate and the end of the filter member according to the fourth embodiment of the present invention.

Described below with reference to FIGS. 18 and 19 is a fourth embodiment.

In the above-mentioned embodiments, the water-draining gate was formed in a spherical shape. However, the water-draining gate and a portion of the filter member that faces the water-draining gate may be constructed in the manner described below.

In FIGS. 18 and 19 a plurality of steps are formed on the surface of the water-draining gate 75, and a portion at the end of the filter member 76, that faces the steps formed on the water-draining gate 75, is formed in a comb shape in such a way that the end will not be hooked by the steps of the water-draining gate 75. Rather, the comb-shaped end of the filter member 76 maintains a predetermined gap relative to the surface of the water-draining gate 75.

By forming the water-draining gate 75 and the filter member 76 to have such shapes, it is possible to move into the pulverizer unit even thin raw garbage that tends to adhere to the surface of the water-draining gate 75.

Moreover, since the end of the filter member 76 and the surface of the water-draining gate 75 are arranged to maintain a predetermined gap relative to each other, the water-draining gate 75 turns with almost no resistance and, hence, only a small force is required for turning the water-draining gate 75. Besides, since the end of the filter member and the surface of the water-draining gate 75 are arranged to maintain a predetermined gap, the filter member is not worn, facilitating maintenance and contributing to improving durability.

The constitution and operation in other respects are the same as those of the first embodiment so that the description thereof is omitted.

Figure 20:
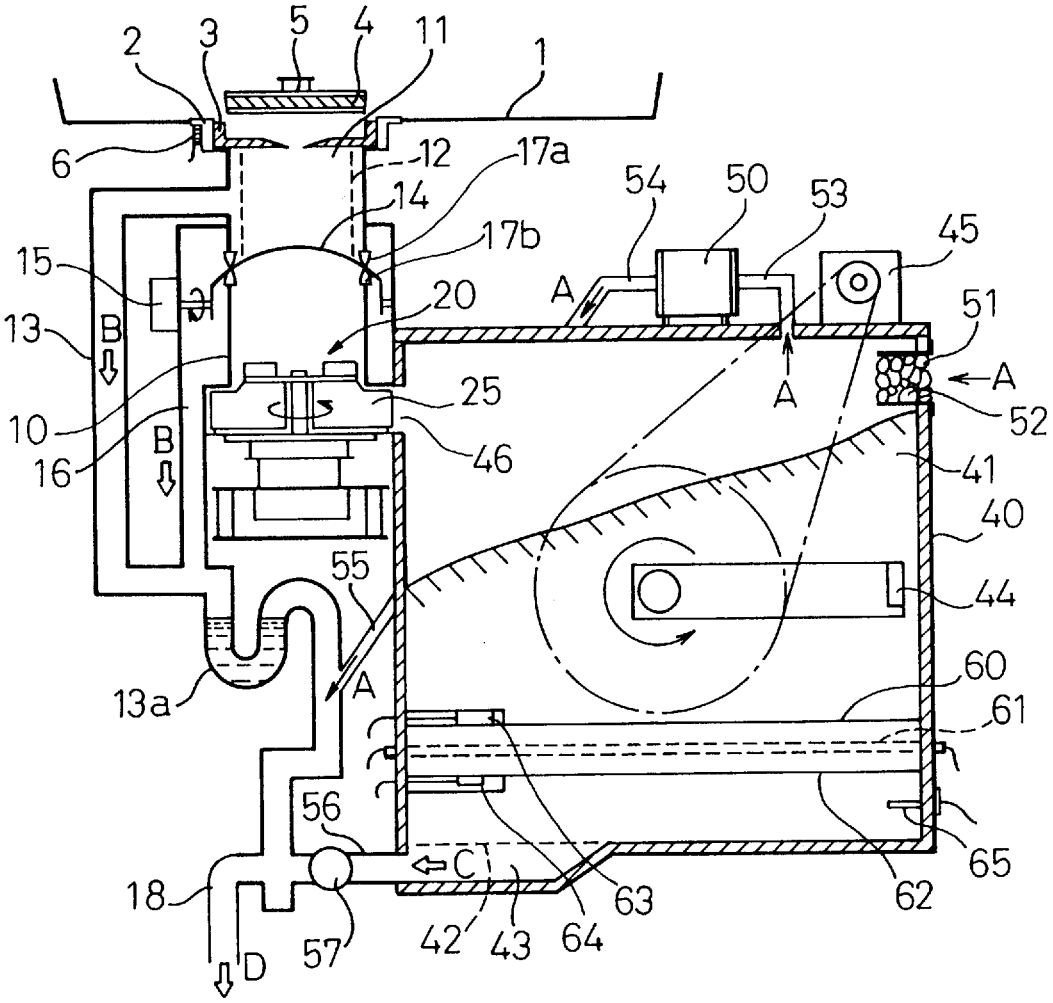
FIG. 20 is a vertical sectional view illustrating a further embodiment of the present invention.

In the above-mentioned embodiments, the carrier duct 30 extends from the outer periphery of the impeller 25 to the microorganism decomposition chamber 40. Alternatively, as shown in FIG. 20, an opening 46 may be formed in a portion of the microorganism decomposition chamber 40 adjacent to and facing the outer peripheral portion of the impeller 25, so that the pulverized raw garbage is directly conveyed into the microorganism decomposition chamber 40 from the opening 46 without employing carrier duct 30.

In the above-mentioned embodiments, furthermore, a plurality of guide plates 26 were provided on the inner wall of the fixed blade 23. Though it is desired to provide a plurality of guide plates 26 from the standpoint of treating the pulverized raw garbage, only one guide plate 26 may be alternatively provided. In the embodiments, furthermore, the heater 60 was provided under the microorganism carrier 41. The heater 60 may alternatively be provided at any position if the microorganism carrier 41 can be uniformly heated and if it does not come in contact with the stirrer vane 44.

Numerical values appearing in the above-mentioned embodiments are only explanatory and do not impose any particular limitation.

In the aforementioned embodiments, the water-draining gate 14 was formed in an upwardly protruded spherical shape. However, there is no particular limitation in its shape provided the passage between the filter member 12 and the pulverizer rotor 24 can be shut off when the water-draining gate 14 is closed.

In the aforementioned embodiments, furthermore, the passage between the filter member 12 and the pulverizer rotor 24 is opened or shut off by turning the water-draining gate 14. It is also allowable that the water-draining gate 14 is formed in the shape of a plate and is slid to open or shut off the passage between the filter member 12 and the pulverizer rotor 24. Moreover, the water-draining gate 14 may be opened and closed like a door to open or shut off the passage between the filter member 12 and the pulverizer rotor 24.

What is claimed is:

1. An apparatus for treating raw garbage comprising:

a water-draining unit having a throw port through which raw garbage is thrown, draining off the water contained in the raw garbage thrown through the throw port, to substantially separate the water contained in the raw garbage;

a drainpipe for draining the water separated from the raw garbage in said water-draining unit;

a pulverizer unit including a pulverizing rotor, pulverizing the raw garbage from which the water has been drained off by said water-draining unit;

a microorganism decomposition unit, including a microorganism carrier carrying microorganisms decomposing the raw garbage from said pulverizer unit;

a stirrer vane installed in said microorganism decomposition unit to stir said microorganism carrier; and a discharge pipe for discharging the water from said drainpipe together with decomposition gases generated in said microorganism decomposition unit.

2. An apparatus for treating raw garbage according to claim 1, wherein:

said water-draining unit includes drain holes formed on a peripheral wall thereof to drain the water; and said pulverizer unit includes a shut-off member disposed between said water-draining unit and said pulverizer unit, said shut-off member being constructed and arranged to be closed or opened to shut off or communicate respectively, a passage between said water-draining unit and said pulverizer rotor;

such that when said shut-of member is closed raw garbage thrown through said throw port accumulates in said water-draining unit and the water drains through said drain holes and flows to the periphery of said pulverizer unit to drain off water contained in the raw garbage thrown through the throwing port; and after the water is drained from the raw garbage, said shut-off member can be opened so that the raw garbage from which the water is drained off is sent to said pulverizer unit.

3. An apparatus for treating raw garbage according to claim 2, further comprising means for rotatably driving said shut-off member to shut off or open the passage between said water draining unit and said pulverizing rotor.

4. An apparatus for treating raw garbage according to claim 3, wherein said shut-off member has an upwardly protruded spherical shape and is turned so as to be opened and closed.

5. An apparatus for treating raw garbage according to claim 3, wherein said pulverizer unit has at least one fixed blade provided to maintain a predetermined gap relative to the outer peripheral portion of said pulverizer rotor, and at least one guide plate that is inclined at a predetermined angle with respect to the inner wall of the fixed blade is installed on the inner wall of the fixed blade.

6. An apparatus for treating raw garbage according to claim 5, wherein a casing for containing said fixed blade has a squeezing portion that is inwardly bent at a predetermined angle from the vicinity of the upper part of said fixed blade.

7. An apparatus for treating raw garbage according to claim 3, wherein said pulverizer unit has a carrier duct for carrying the raw garbage that has been pulverized, said carrier duct being arranged from the outer peripheral portion of the rotary vane attached to the lower part of said pulverizer rotor through to said microorganism decomposition unit and is flared toward said microorganism decomposition unit.

8. An apparatus for treating raw garbage according to claim 3 further comprising a suction-type ventilation pump for introducing the external air into said microorganism decomposition unit and for expelling, together with said external air, decomposition gases generated in said microorganism decomposition unit to the outside.

9. An apparatus for treating raw garbage according to claim 3, wherein said microorganism carrier is provided with a heater for heating the raw garbage to a temperature that kills vermin but does not kill microorganisms.

10. An apparatus for treating raw garbage according to claim 8, wherein a coupling pipe for coupling said microorganism decomposition unit to said discharge pipe is provided with a check valve to prevent a counter flow into said microorganism decomposition unit from said discharge pipe.

11. An apparatus for treating raw garbage according to claim 3, wherein said pulverizer unit is provided with a control means which rotates said pulverizer rotor in the forward direction and in the reverse direction at a predetermined frequency for a predetermined period of time when the raw garbage from which the water has been drained off via said shut-off member falls and accumulates in a predetermined amount on an upper part of said pulverizer rotor.

12. An apparatus for treating raw garbage according to claim 11, wherein, when said shut-off member is not turned up to a predetermined position, said control means stops the operation of said pulverizer rotor and generates an abnormal signal.

13. An apparatus for treating raw garbage according to claim 11, wherein, when either of the temperature of a heater temperature detector for detecting the temperature on the surface of said heater or the temperature of a carrier temperature detector for detecting the temperature of said microorganism carrier exceeds the respective upper limit of their preset temperatures, said control means interrupts the supply of current to said heater; and when either of the temperatures becomes lower than corresponding lower limit of their preset temperatures, said control means supplies the current to said heater; said control means actuating said stirrer vane while the current is being fed to said heater.

14. An apparatus for treating raw garbage comprising:

a water-draining unit having a throw port through which raw garbage is thrown, for draining off the water contained in the raw garbage thrown through the throw port, to substantially separate the water contained in the raw garbage;

a pulverizer unit, including a pulverizer rotor, pulverizing the raw garbage from which the water has been drained off by said water-draining unit;

a microorganism decomposition unit, including a microorganism carrier carrying microorganisms, decomposing the raw garbage from said pulverizer unit;

a drainpipe for draining the water from said water-draining unit together with decomposition gases generated in said microorganism decomposition unit.

* * * * *